US008827520B2

(12) United States Patent
Shibata et al.

(10) Patent No.: US 8,827,520 B2
(45) Date of Patent: Sep. 9, 2014

(54) VEHICLE HEADLIGHT

(75) Inventors: Hiroki Shibata, Shizuoka (JP); Kazutami Oishi, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 367 days.

(21) Appl. No.: 13/278,638

(22) Filed: Oct. 21, 2011

(65) Prior Publication Data

US 2012/0113662 A1 May 10, 2012

(30) Foreign Application Priority Data

Nov. 8, 2010 (JP) ..... 2010-249442

(51) Int. Cl.
*B60Q 1/00* (2006.01)
*F21S 8/10* (2006.01)

(52) U.S. Cl.
CPC ..... *F21S 48/1773* (2013.01)
USPC ..... 362/539; 362/512

(58) Field of Classification Search
USPC ..... 362/539, 512, 538
See application file for complete search history.

(56) References Cited

U.S. PATENT DOCUMENTS

| | | | | |
|---|---|---|---|---|
| 5,899,559 | A * | 5/1999 | Lachmayer et al. | 362/513 |
| 2009/0059612 | A1 | 3/2009 | Yang et al. | |
| 2010/0008100 | A1 | 1/2010 | Tatsumi et al. | |
| 2010/0103690 | A1 * | 4/2010 | Keilig | 362/513 |

FOREIGN PATENT DOCUMENTS

| | | | |
|---|---|---|---|
| EP | 1 201 988 | A2 | 5/2002 |
| EP | 2 180 245 | A1 | 4/2010 |
| JP | 2009-230958 | A | 10/2009 |

OTHER PUBLICATIONS

Extended European Search Report issued by the European Patent Office in corresponding European Apllication No. 11188143.9 on Feb. 23, 2012.

* cited by examiner

*Primary Examiner* — Julie Bannan
(74) *Attorney, Agent, or Firm* — Sughrue Mion, PLLC

(57) ABSTRACT

There is provided a vehicle headlight. The vehicle headlight includes: a light source configured to emit light; a reflector reflecting the light; a projection lens projecting the light; a stationary shade blocking a part of the light emitted from the light source; a movable shade supported by the stationary shade as to move between a shielding position and a non-shielding position and configured to block a part of the light emitted from the light source; a drive mechanism including: a yoke; a coil disposed in the yoke; and an output shaft configured to move in an axial direction thereof in response to current supplied to the coil, and a transmission mechanism transmitting a driving force of the drive mechanism to the movable shade. At least a part of the yoke of the drive mechanism is formed in a single piece with the stationary shade.

7 Claims, 7 Drawing Sheets

VEHICLE HEADLIGHT

CROSS-REFERENCE TO RELATED APPLICATION

This application claims priority from Japanese Patent Application No. 2010-249442, filed on Nov. 8, 2010, the entire contents of which are hereby incorporated by reference.

BACKGROUND

1. Technical Field

The present disclosure relates to a vehicle headlight. More particularly, the present disclosure relates to a technique that reduces the size of a vehicle headlight and the number of components of the vehicle headlight by integrally forming a yoke of a drive mechanism, which rotates a movable shade, with a stationary shade that blocks a part of light emitted from a light source.

2. Related Art

As a vehicle headlight, there is, for example, a vehicle headlight where a lamp unit including a light source is disposed in a lamp casing formed of a cover and a lamp housing.

As a lamp unit of a vehicle headlight, there is a lamp unit that includes a stationary shade and a movable shade and can switch the irradiation mode of light emitted from a light source by the rotation of the movable shade relative to the stationary shade (for example, see JP-A-2009-230958).

In the vehicle headlight disclosed in JP-A-2009-230958, for example, a mode is switched to a so-called low-beam irradiation mode irradiating at a short distance when the movable shade is rotated to a shielding position where the movable shade blocks light emitted from the light source, and a mode is switched to a so-called high-beam irradiation mode irradiating at a long distance when the movable shade is rotated to a non-shielding position where the movable shade does not block light emitted from the light source.

The vehicle headlight disclosed in JP-A-2009-230958 is provided with a drive mechanism for rotating the movable shade, and the drive mechanism is formed of an electromagnetic actuator that includes a coil, a yoke, and an output shaft. Accordingly, as current is supplied to the coil of the electromagnetic actuator and the supply of current to the coil of the electromagnetic actuator is stopped, the movable shade is rotated between the shielding position and the non-shielding position.

Meanwhile, it is preferable that the size of a vehicle headlight including a lamp unit be reduced. In particular, in recent years, there has been a demand for the further reduction of the size of a vehicle headlight that is accompanied by the shortening of the focal length of an optical system provided in a vehicle headlight.

Further, it is preferable that the structure of a vehicle headlight also be simple, and it is preferable that the number of components of the vehicle headlight be reduced.

Meanwhile, in the vehicle headlight disclosed in JP-A-2009-230958, a drive mechanism for rotating the movable shade relative to the stationary shade is disposed below the stationary shade. For this reason, the height of a beam switching structure, which includes the stationary shade and the movable shade, in the up-down direction is particularly large and it is difficult to reduce the size of the vehicle headlight.

SUMMARY OF THE INVENTION

Exemplary embodiments of the present invention may address the above disadvantages and other disadvantages not described above. However, the present invention is not required to overcome the disadvantages described above, and thus, an exemplary embodiment of the present invention may not overcome any disadvantages.

One of illustrative aspects of the present invention is to overcome the above-mentioned problem and to reduce the size of a vehicle headlight and the number of components of the vehicle headlight.

According to one or more illustrative aspects of the present invention, there is provided a vehicle headlight. The vehicle headlight comprises: a lamp casing and a lamp unit disposed in the lamp casing. The lamp casing comprises: a lamp housing, wherein at least one surface of the lamp housing is opened; a cover attached to the lamp housing to cover the at least one surface of the lamp housing. The lamp unit comprises: a light source configured to emit light; a reflector comprising a reflective surface that reflects the light emitted from the light source; a projection lens that projects the light emitted from the light source toward a forward area; a stationary shade disposed between the projection lens and the light source and configured to block a part of the light emitted from the light source; a movable shade supported by the stationary shade as to move between a shielding position and a non-shielding position and configured to block a part of the light emitted from the light source when the movable shade is located in the shielding position; a drive mechanism configured to rotate the movable shade, the drive mechanism comprising: a yoke; a coil disposed in the yoke; and an output shaft configured to move in an axial direction thereof in response to current supplied to the coil, and a transmission mechanism configured to transmit a driving force of the drive mechanism to the movable shade. At least a part of the yoke of the drive mechanism is formed in a single piece with the stationary shade.

Accordingly, it may be possible to reduce the size of the vehicle headlight and the number of components of the vehicle headlight.

According to one or more illustrative aspects of the present invention, an optical axis of the light source is located between a middle of the yoke in a left-right direction thereof and a rotation center of the movable shade in a left-right direction orthogonal to a longitudinal direction of the vehicle headlamp.

Accordingly, it may be possible to make the barycenter of the lamp unit be close to the middle of the stationary shade in the left-right direction and to improve vibration resistance.

According to one or more illustrative aspects of the present invention, the yoke comprises: a plurality of surface portions, and the yoke comprises: an integrated yoke portion formed in a single piece with the stationary shade; and a separate yoke portion connected to the integrated yoke portion and formed separately from the stationary shade. Each of the integrated yoke portion and the separate yoke portion comprises at least two surface portions of the surface portions.

Accordingly, it may be possible to easily form the yoke by joining the separate yoke portion to the integrated yoke portion.

According to one or more illustrative aspects of the present invention, the yoke forms a closed magnetic path portion formed in a rectangular frame and having an opening in a longitudinal direction of the vehicle headlamp, the closed magnetic path portion having four surface portions of the surface portions. The four surface portions of the closed magnetic path portion has: a first side surface portion; a lower surface portion; a second side surface portion; and an upper surface portion. The integrated yoke portion comprises: the first side surface portion; and the lower surface portion, and the separate yoke portion comprises: the second side surface portion; and the upper surface portion.

Accordingly, it may be possible to increase the driving force of the drive mechanism by the closed magnetic path portion and to easily form the closed magnetic path portion by joining the separate yoke portion to the integrated yoke portion.

According to one or more illustrative aspects of the present invention, either the integrated yoke portion or the separate yoke portion further comprises a front surface portion configured to cover the opening of closed magnetic path portion.

Accordingly, not only the closed magnetic path portion but also the front surface portion contributes to the increase of the driving force of the drive mechanism and the inner structure of the yoke is not seen from the outside of the cover. Therefore, it may be possible to improve the appearance of the yoke.

Other aspects and advantages of the present invention will be apparent from the following description, the drawings and the claims.

DETAILED DESCRIPTION

Figure 1:
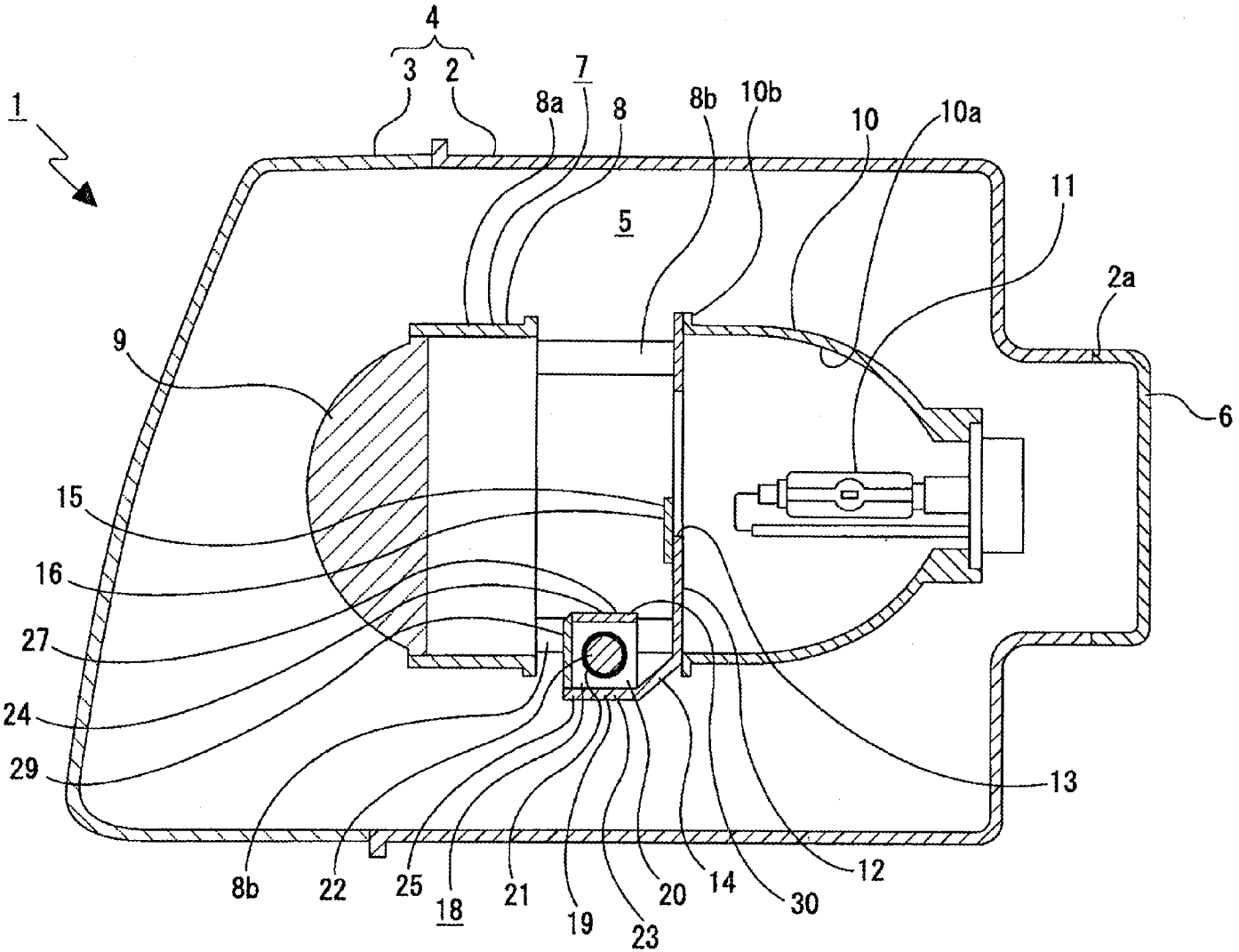
FIG. 1 is a schematic view showing a vehicle headlight according to an embodiment of the invention.

Exemplary embodiments of the invention will be described below with reference to the drawings. The same or equivalent elements, members, and processes, which are shown in the respective drawings, are denoted by the same reference numerals, and repeated description thereof will be appropriately omitted. Further, the embodiments are illustrative and do not limit the invention. The characteristics or combinations described in the embodiments are not necessarily essential in the invention.

A vehicle headlight according to a preferred embodiment of the invention will be described below with reference to the accompanying drawings.

Vehicle headlights 1 are disposed and mounted on both left and right end portions of the front end portion of a vehicle body.

As shown in FIG. 1, the vehicle headlight 1 includes a lamp housing 2 and a cover 3. The lamp housing 2 includes a recess that is opened to the front side, and the cover 3 closes the opening of the lamp housing 2. A lamp casing 4 is formed of the lamp housing 2 and the cover 3, and an inner space of the lamp casing 4 is formed as a lamp chamber 5.

A mounting hole 2*a*, which is opened in a front-rear direction, is formed at a rear end portion of the lamp housing 2. A back cover 6 is mounted at the mounting hole 2*a*.

Figure 2:
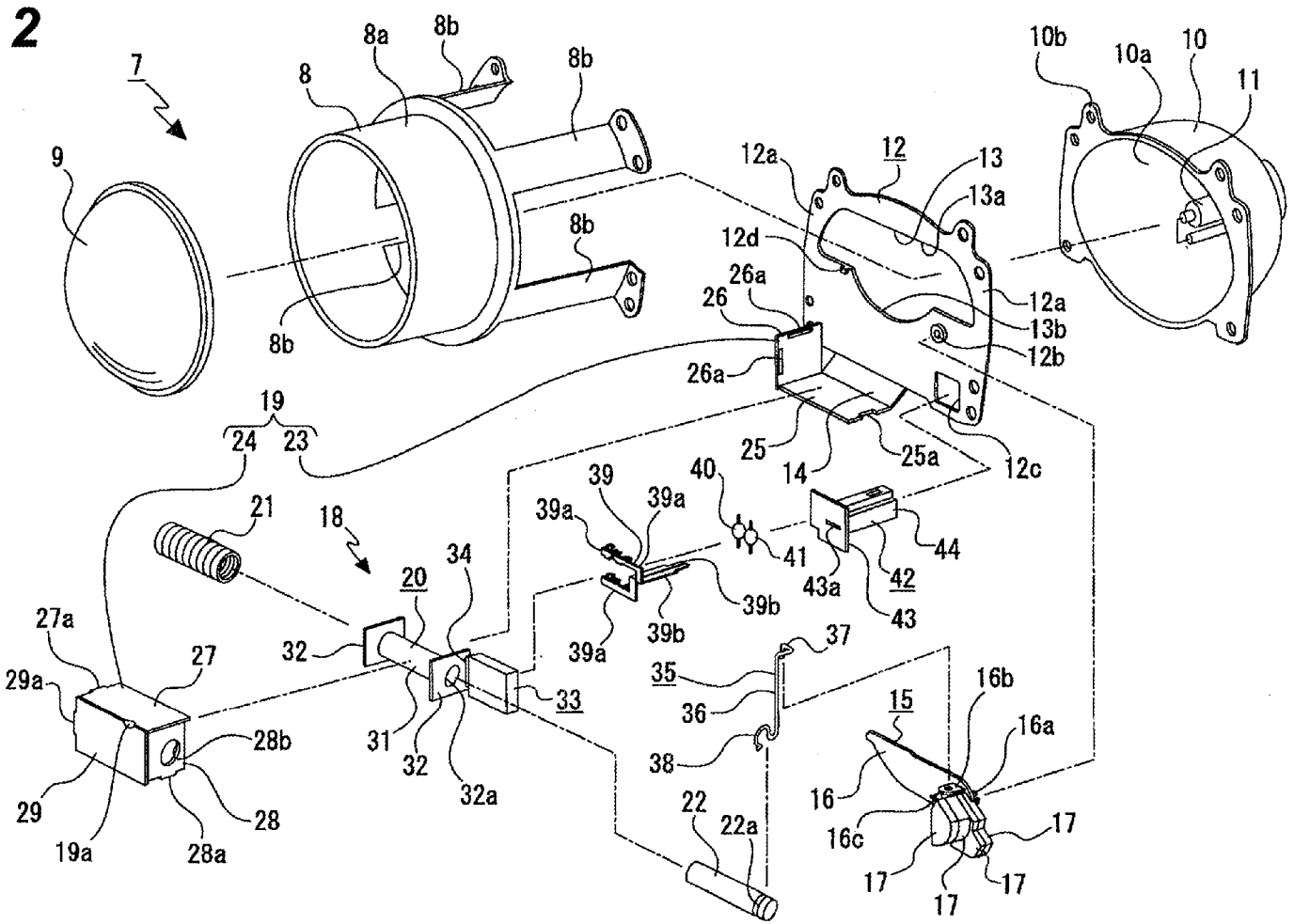
FIG. 2 is an exploded perspective view of a lamp unit.

A lamp unit 7 is disposed in the lamp chamber 5 (see FIGS. 1 and 2). The lamp unit 7 includes a lens holder 8, a projection lens 9 that is mounted on the front end portion of the lens holder 8, a reflector 10 that is positioned on the rear side of the lens holder 8, and a light source 11 that is mounted on the rear end portion of the reflector 10. For example, a discharge lamp is used as the light source 11.

The lens holder 8 includes a cylindrical lens mounting portion 8*a* that is opened in the front-rear direction; and a plurality of mounting leg portions 8*b*, 8*b*, . . . that are spaced apart from each other in a circumferential direction and protrude rearward from the lens mounting portion 8*a*.

The inner surface of the reflector 10 is formed as a reflective surface 10*a*. A fastening portion 10*b*, which protrudes outward, is formed at the reflector 10.

Figure 3:
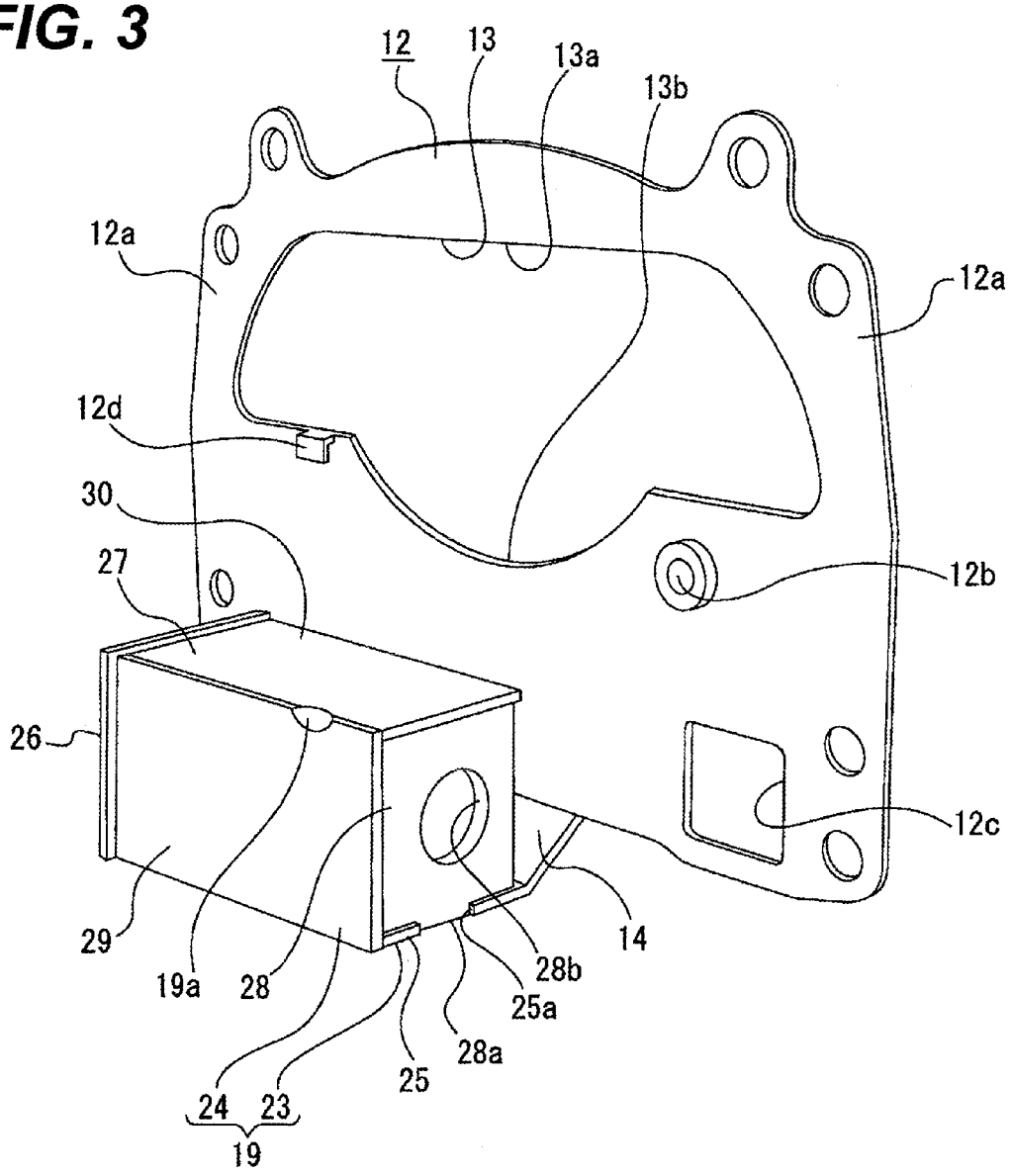
FIG. 3 is a perspective view showing a stationary shade and a yoke.

The lens holder 8 and a stationary shade 12 are mounted on the fastening portion 10*b* of the reflector 10 in this order from the front side by, for example, screwing or the like. The stationary shade 12 is formed in the shape of a plate facing the front-rear direction, and both left and right side portions of the stationary shade are formed as mounted portions 12*a* and 12*a*, which are mounted on the fastening portion 10*b* of the reflector 10, as shown in FIGS. 2 and 3.

A light transmission hole 13 is formed at the stationary shade 12. The light transmission hole 13 includes a horizontally long first portion 13*a* and a continuous second portion 13*b* that is formed at a portion of the lower end of the first portion 13*a* except for both left and right portions. The second portion 13*b* is formed substantially in the shape of a circular arc of which an opening edge is convex downward.

A support hole 12*b* is formed at the stationary shade 12 at the position that is near the left end of the stationary shade 12 and immediately below the light transmission hole 13. An insertion hole 12*c* is formed at the lower end portion of the left end portion of the stationary shade 12.

A stopper piece 12*d*, which protrudes forward, is formed at the lower opening edge of the light transmission hole 13 at the position that is near the right end of the stationary shade 12.

A connecting plate portion 14, which protrudes obliquely forward and downward, is formed integrally with the lower end portion of the stationary shade 12.

The rear end portions of the mounting leg portions 8*b*, 8*b*, . . . of the lens holder 8 are joined to the mounted portions 12*a* and 12*a* of the stationary shade 12 from the front side, and the mounting leg portions 8*b*, 8*b*, . . . and the mounted portions 12*a* and 12*a* are joined to the fastening portion 10*b* of the reflector 10 by screwing or the like (see FIG. 2).

Figure 4:
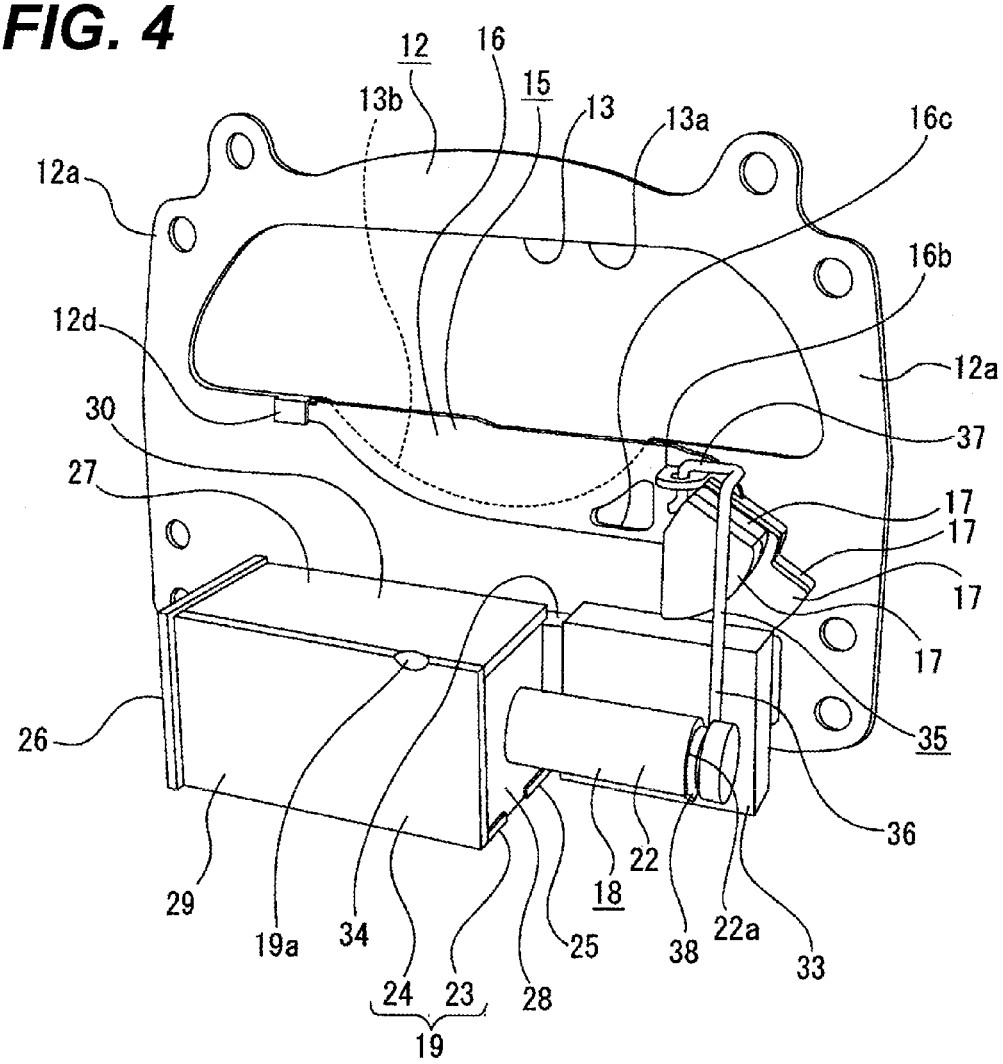
FIG. 4 is a perspective view showing a movable shade located at a shielding position.
Figure 5:
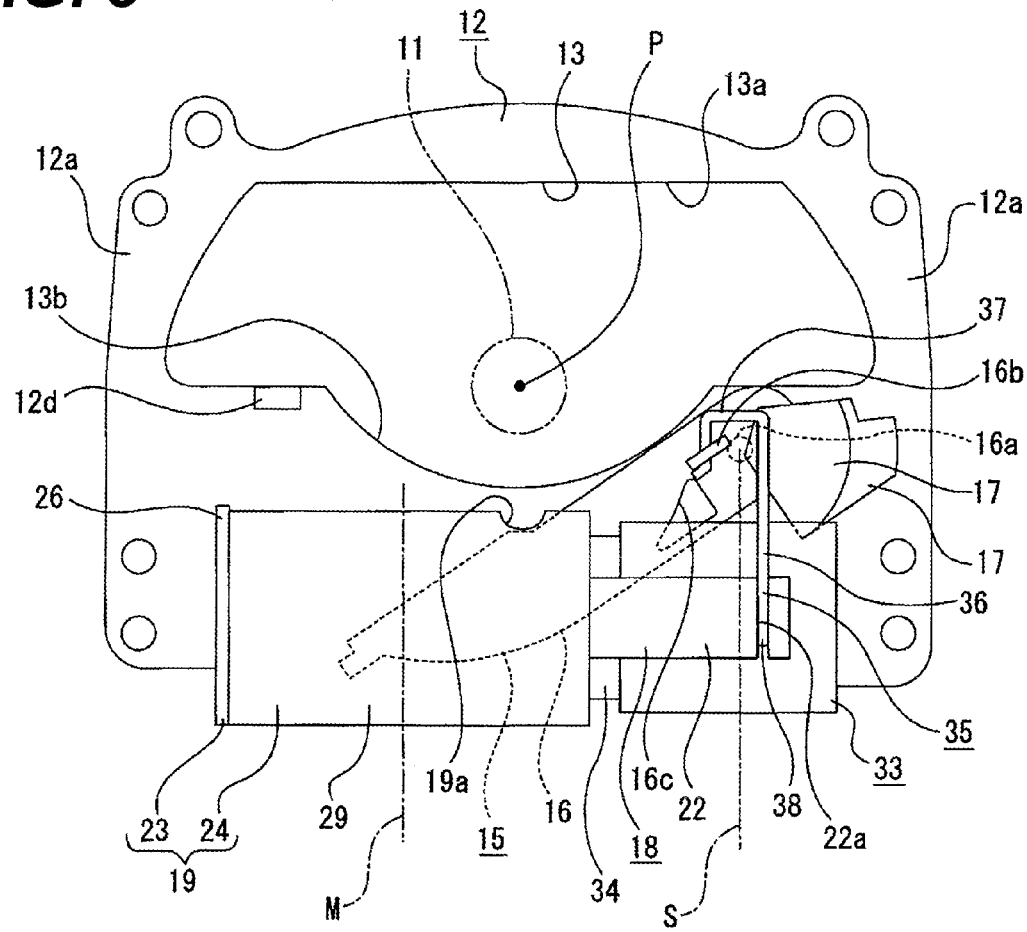
FIG. 5 is a front view showing the movable shade located at a non-shielding position.

A movable shade 15 is rotatably supported on the front surface of the stationary shade 12 (see FIGS. 2, 4, and 5). The movable shade 15 includes a plate-like light blocking portion 16 that extends substantially in the left-right direction, and a plurality of weights 17, 17, . . . that are mounted on the front surface of the left end portion of the light blocking portion 16.

A supported shaft 16*a*, which protrudes rearward, is formed on the light blocking portion at the position near the left end of the light blocking portion 16. A connecting piece 16*b*, which protrudes forward, is formed at the left end portion of the light blocking portion 16.

The supported shaft 16*a* of the light blocking portion 16 is inserted into the support hole 12*b* of the stationary shade 12 from the front side, so that the movable shade 15 is connected to the stationary shade and can be rotated relative to the stationary shade 12 about the supported shaft 16*a* as a fulcrum. The supported shaft 16*a* of the movable shade 15 is positioned near the right ends of the weights 17, 17, . . . . A balance hole 16*c* is formed at the light blocking portion 16 of the movable shade 15. The balance hole 16*c* is formed at a portion of the light blocking portion that overlaps with the stationary shade 12 in the front-rear direction even when the movable shade 15 is at any position in a rotation range.

Accordingly, the balance hole 16*c* does not overlap with the light transmission hole 13, which is formed at the stationary shade 12, in the rotation range of the movable shade 15.

The movable shade 15 is adapted to be capable of being rotated between a shielding position (see FIG. 4) where the second portion 13*b* of the light transmission hole 13 formed at the stationary shade 12 is closed and a non-shielding position (see FIG. 5) where the second portion 13*b* is opened. The rotation of the movable shade 15 is restricted by the stopper piece 12*d* formed at the stationary shade 12, so that the movable shade 15 is held at the shielding position.

The vehicle headlight 1 is provided with a pushing spring (not shown) that pushes the movable shade 15 in a rotational direction from the non-shielding position toward the shielding position. When a rotating force in the direction from the non-shielding position toward the shielding position is not applied to the movable shade 15, the movable shade 15 is pressed against the stopper piece 12*d* formed at the stationary shade 12 by the pushing force of the pushing spring. Accordingly, the rotation of the movable shade 15 is restricted, so that the movable shade 15 is held at the shielding position.

When the movable shade 15 is rotated to the shielding position, a part of the light emitted from the light source 11 is blocked by the stationary shade 12 and the movable shade 15. Accordingly, a mode is switched to a so-called low-beam irradiation mode that irradiates at a short distance. Further, when the movable shade 15 is rotated to the non-shielding position, a part of the light emitted from the light source 11 is blocked by only the stationary shade 12. Accordingly, a mode is switched to a so-called high-beam irradiation mode that irradiates at a long distance.

Meanwhile, when vibration is generated at the vehicle headlight 1, there is a concern that a rotating force in the rotational direction from the shielding position toward the non-shielding position is applied to the movable shade 15. However, the movable shade 15 is provided with the weights 17, 17, . . . as described above. Accordingly, rotational moment in the rotational direction toward the non-shielding position is reduced by the weights 17, 17, . . . , so that it may be possible to prevent the movable shade 15 from being unnecessarily rotated toward the non-shielding position when vibration is generated.

Further, since the weights 17, 17, . . . have a function of generating a rotating force in the same direction as the direction where the pushing force of the pushing spring is applied, the size of the pushing spring may be reduced by that much. This contributes to the reduction of the size of the vehicle headlight 1.

Furthermore, since the balance hole 16*c* formed at the movable shade 15 also has the same function as the weights 17, 17, . . . , it may be possible to prevent the movable shade 15 from being unnecessarily rotated toward the non-shielding position when vibration is generated and the size of the pushing spring may be reduced. This contributes to the reduction of the size of the vehicle headlight 1.

In addition, since the balance hole 16*c* is formed, the mass of the weights 17, 17, . . . may be reduced. Accordingly, it may be possible to reduce the weight of the vehicle headlight 1.

The movable shade 15 is rotated by a drive mechanism 18. For example, an electromagnetic actuator is used as the drive mechanism 18, and the drive mechanism 18 includes a yoke 19, a coil bobbin 20, a coil 21, and an output shaft 22.

The yoke 19 includes an integrated yoke portion 23 that is formed integrally with the stationary shade 12, and a separate yoke portion 24 that is joined to the integrated yoke portion 23 and formed separately from the stationary shade 12.

The integrated yoke portion 23 includes, for example, a lower surface portion 25 and a side surface portion 26 that protrudes upward from one side edge of the lower surface portion 25. The rear edge of the lower surface portion 25 is connected to the front edge of the connecting plate portion 14. Joint grooves 25*a*, 26*a*, and 26*a* are formed at the other side edge of the lower surface portion 25 and the upper and front edges of the side surface portion 26, respectively.

The separate yoke portion 24 includes an upper surface portion 27, a side surface portion 28 that protrudes upward from one side edge of the upper surface portion 27, and a front surface portion 29 that protrudes downward from the front edge of the upper surface portion 27. One side edge of the front surface portion 29 and the front edge of the side surface portion 28 are connected to each other. Joint protrusions 27*a*, 28*a*, and 29*a* are formed at the other side edge of the upper surface portion 27, the lower edge of the side surface portion 28, and one side edge of the front surface portion 29, respectively. A shaft insertion hole 28*b* is formed at the central portion of the side surface portion 28.

The joint protrusions 27*a*, 28*a*, and 29*a* are inserted into the joint grooves 26*a*, 25*a*, and 26*a*, respectively, and the separate yoke portion 24 is joined to the integrated yoke portion 23 by adhesion or the like. When the separate yoke portion 24 is joined to the integrated yoke portion 23, a yoke 19 having the shape of a horizontally long box opened to the rear side is formed. The separate yoke portion 24 functions as a cover that covers the respective portions disposed in the yoke 19.

The width of the side surface portion 28 in the front-rear direction is smaller than that the width of the upper surface portion 27 in the front-rear direction, so that the rear edge of the side surface portion 28 is positioned on the front side of the rear edge of the upper surface portion 27.

A closed magnetic path portion 30 is formed in the yoke 19. The closed magnetic path portion 30 is formed in the shape of a bar, which has a rectangular cross-section, by the lower surface portion 25, the upper surface portion 27, and the side surface portions 26 and 28 so as to be opened in the front-rear direction. A clearance recess 19*a* is formed at the upper end portion of the front end portion of the yoke 19.

When light is emitted from the light source 11 in the vehicle headlight 1, downward light exists in the light transmitted through the light transmission hole 13 of the stationary shade 12. However, it may be possible to secure a good irradiation state of light by the clearance recess 19*a* without irradiating the yoke 19 with the downward light. Further, since a portion, which secures a good irradiation state of light, is the recess (clearance recess 19*a*), it may be possible to reduce the influence of the yoke 19 on a magnetic path as compared to when a clearance hole is formed in order to secure a good irradiation state of light.

The yoke 19 is positioned on the front side of the stationary shade 12, the middle M of the yoke in the left-right direction is positioned on the right side of an optical axis P of the light source 11, and a rotation center S of the movable shade 15 is positioned on the left side of the optical axis P of the light source 11 (see FIG. 5). That is, the middle M of the yoke 19 in the left-right direction and the rotation center S of the movable shade 15 are positioned on the opposite sides of the light source 11 in the left-right direction.

Figure 6:
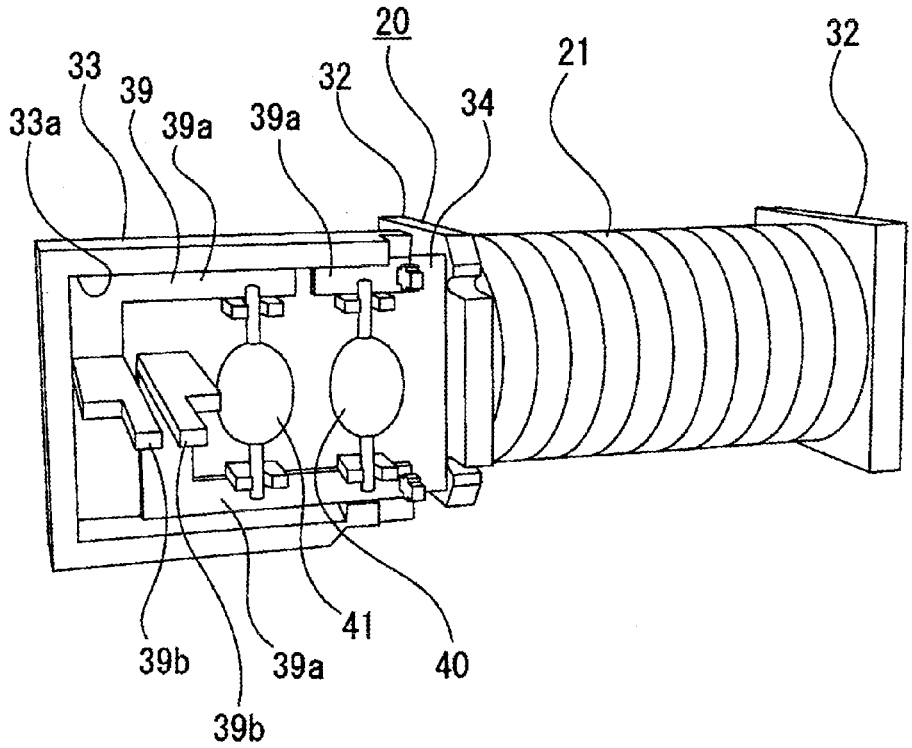
FIG. 6 is a perspective view showing a coil, a coil bobbin, a disposition case, and respective components disposed in the disposition case.

As shown in FIGS. 2 and 6, the coil bobbin 20 includes a cylindrical portion 31 that extends in the left-right direction and pressing portions 32 and 32 that provided at both left and right end portions of the cylindrical portion 31, respectively. Each of the pressing portions 32 and 32 is formed in the shape of a plate facing the left-right direction, and a shaft insertion hole 32*a* is formed at the pressing portion 32 that is positioned on at least the left side.

A disposition case 33, which protrudes to the left side, is mounted on the rear end portion of the pressing portion 32 that is positioned on the left side. The disposition case 33 is formed in the shape of a box opened to the rear side, and the inside of the disposition case is formed as a disposition space 33*a*. The right end portion of the disposition case 33 is formed as a connecting portion 34 of which the outer shape is smaller than other portions.

The coil 21 is externally mounted on the cylindrical portion 31 of the coil bobbin 20. The coil bobbin 20 on which the coil 21 has been mounted is disposed in the yoke 19, and the disposition case 33 is positioned so as to protrude from the yoke 19 to the left side. In this case, the connecting portion 34 of the disposition case 33 is positioned on the rear side of the side surface portion 28 of the yoke 19.

A connecting groove 22*a*, which extends in the circumferential direction, is formed on the output shaft 22 at the position near the left end of the output shaft (see FIGS. 2, 4, and 5). The right end portion of the output shaft 22 is inserted into the cylindrical portion 31 through the shaft insertion hole 28*b* that is formed at the side surface portion 28 of the yoke 19 and the shaft insertion hole 32*a* that is formed at the pressing portion 32 of the coil bobbin 20.

A driving force of the drive mechanism 18 is transmitted to the movable shade 15 by a link member 35 that functions as a transmission mechanism. The link member 35 is formed of a metal material that is bent in a predetermined shape. The link member 35 includes an extension portion 36 that extends in an up-down direction, a first joint portion 37 that is bent from the upper end of the extension portion 36, and a second joint portion 38 that is bent from the lower end of the extension portion 36.

The first joint portion 37 is joined to the connecting piece 16*b*, so that the link member 35 is connected to the movable shade 15. The second joint portion 38 is joined to the connecting groove 22*a* of the output shaft 22, so that the link member 35 is connected to the drive mechanism 18. Both the connecting piece 16*b* that is a connecting point of the first joint portion 37 and the connecting groove 22*a* of the output shaft 22 that is a connecting point of the second joint portion 38 are positioned on the left side of the optical axis P of the light source 11 (see FIG. 5).

As described above, the link member 35 is provided so as to exist at a position where the link member connects the connecting piece 16*b* to the connecting groove 22*a*, so that the connecting point of the movable shade 15 and the connecting point of the output shaft 22 are at positions close to each other. Accordingly, it may be possible to improve the efficiency of the transmission of the driving force of the drive mechanism 18 to the movable shade 15.

Further, since the link member 35 is formed of a wiry metal material that is bent in a predetermined shape and the extension portion 36 of the link member 35 is formed so as to extend linearly, it may be possible to reduce the manufacturing costs of the link member 35 and to simplify the structure of the link member 35.

A connection terminal 39, a first diode 40, and a second diode 41 are disposed in the disposition case 33 that protrudes from the yoke 19 to the left side.

The connection terminal 39 includes base portions 39*a*, 39*a*, and 39*a* that are mounted in the disposition case 39, and connection portions 39*b* and 39*b* that protrude rearward from the base portions 39*a* and 39*a*.

The first diode 40 is a diode that absorbs a counter electromotive force. The first diode 40 having a function, which reduces noise by absorbing magnetic energy discharged when the supply of current to the coil 21 is stopped, is disposed at a portion close to the coil 21 in the disposition case 33, and is connected between the base portions 39*a* and 39*a*.

The second diode 41 is a diode that protects a circuit when being reversely connected. The second diode 41 is disposed on the left side of the first diode 40 and is connected between the base portions 39*a* and 39*a*.

In the vehicle headlight 1, as described above, the first diode 40, which absorbs magnetic energy discharged when the supply of current to the coil 21 is stopped, is disposed closer to the coil 21 than the second diode 41. Accordingly, since a distance between the first diode 40 and the coil 21 is small, it may be possible to successfully exhibit a function of absorbing magnetic energy by the first diode 40.

Further, since the connection terminal 39, the first diode 40, and the second diode 41 are disposed in the disposition case 33, it may be possible to reduce the size of the vehicle headlight by the integration of functions and the effective use of a disposition space.

Furthermore, since the disposition case 33 is provided on the coil bobbin 20, it is not necessary to form the disposition case 33 as a separate component and it may be possible to reduce the size of the vehicle headlight by the reduction of the number of components and the effective use of a disposition space.

A connector case 42 is mounted on the rear end portion of the disposition case 33. The connector case 42 includes a plate-like closing surface portion 43 and a cylindrical case portion 44 that are formed integrally with each other. The closing surface portion 43 closes the inner space 33*a* of the disposition case 33. The case portion 44 protrudes rearward from the closing surface portion 43. A terminal insertion hole 43*a* is formed at the closing surface portion 43 so as to pass through the closing surface portion in the front-rear direction.

While the connector case 42 is mounted on the disposition case 33, the connection portions 39*b* and 39*b* of the connection terminal 39 are inserted into the terminal insertion hole 43*a* from the front side. Accordingly, the connection portions 39*b* and 39*b* are positioned in the case portion 44.

Figure 7:
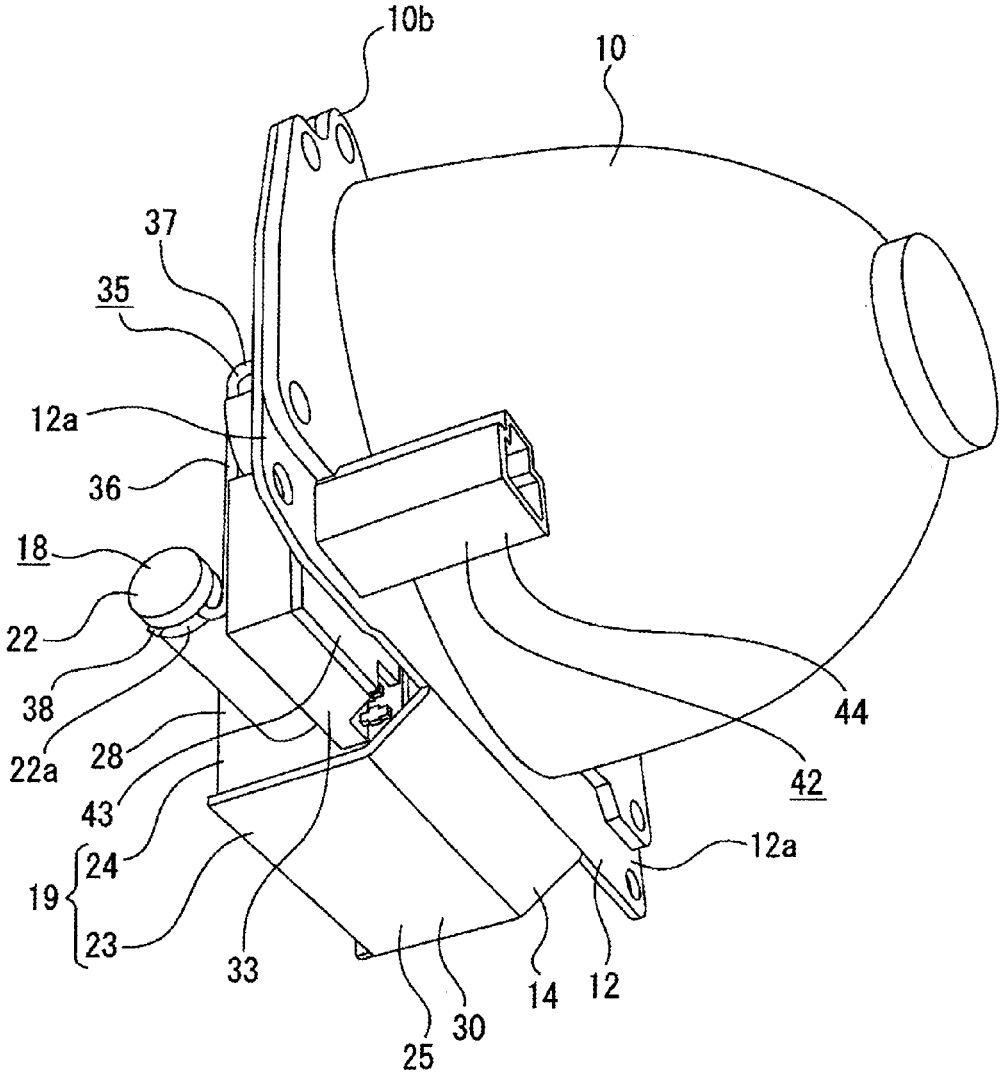
FIG. 7 is a perspective view of a reflector and the like when seen from the back side.

The case portion 44 of the connector case 42 and the connection portions 39*b* and 39*b* of the connection terminal 39 are inserted into the insertion hole 12*c* formed at the stationary shade 12, protrude to the rear side of the stationary shade 12, and are positioned on the outside of the reflector 10 (see FIG. 7). A plug, which is connected to a power circuit (not shown), is connected to the connection portions 39*b* and 39*b* of the connection terminal 39. Accordingly, driving current is supplied to the coil 21 from the power circuit through the connection terminal 39.

Since the case portion 44 of the connector case 42, in which the connection portions 39*b* and 39*b* of the connection terminal 39 are positioned as described above, is disposed on the outside of the reflector 10, the influence of heat between the case portion 44 and the space in the reflector 10 is suppressed.

In the vehicle headlight 1, as described above, the rotation of the movable shade 15 is restricted by the stopper piece 12*d* formed at the stationary shade 12 pushed by the pushing force of the pushing spring while current is not supplied to the coil 21. Accordingly, the movable shade 15 is held at the shielding position (see FIG. 4). In this case, the length of a portion of the output shaft 22 of the drive mechanism 18, which protrudes from the yoke 19, is longest.

When current is supplied to the coil 21 in the vehicle headlight 1, the output shaft 22 is moved in the axial direction, the length of a portion of the output shaft protruding from the yoke 19 is reduced, and the driving force of the drive mechanism 18 is transmitted to the movable shade 15 through the link member 35. Accordingly, the movable shade 15 is rotated about the supported shaft 16*a* as a fulcrum up to the non-shielding position against the pushing force of the pushing spring (see FIG. 5).

When the supply of current to the coil 21 is stopped, the movable shade 15 is rotated about the supported shaft 16*a* as a fulcrum up to the shielding position by the pushing force of the pushing spring (see FIG. 4).

A bar-like frame (not shown) where the lamp unit 7 is supported is disposed in the lamp chamber 5, and the frame is tiltably supported by the lamp housing 2 through an aiming adjustment mechanism (not shown). Accordingly, the lamp unit 7 and the frame are integrally tilted in the up-down direction or the left-right direction by the operation of the aiming adjustment mechanism, so that the adjustment (initial adjustment) of the optical axis of the light source 11 is performed.

Further, the lamp unit 7 may be supported by the frame so as to be tiltable, for example, in the up-down direction. If the lamp unit 7 is supported by the frame so as to be tiltable in the up-down direction, a leveling adjustment mechanism (not shown) is connected to the lamp unit 7 and the lamp unit 7 is tilted in the up-down direction by the operation of the leveling adjustment mechanism. Accordingly, the orientation of the optical axis of the light source 11 is adjusted according to the weight of materials loaded on a vehicle.

The leveling adjustment mechanism includes a leveling actuator that is disposed below the stationary shade 12. A connection portion, which protrudes downward, is formed at the lower end portion of the stationary shade 12, and the connection portion is connected to the leveling actuator. Accordingly, a driving force of the leveling actuator is transmitted to the lamp unit 7 through the connection portion, so that the lamp unit 7 is tilted in the up-down direction. Therefore, the orientation of the optical axis of the light source 11 is adjusted according to the weight of materials loaded on a vehicle.

When the leveling adjustment mechanism is to be provided in the vehicle headlight 1 as described above, it is preferable that the connection portion formed at the lower end portion of the stationary shade 12 be positioned near the barycenter of the lamp unit 7. It may be possible to improve vibration resistance by positioning the connection portion near the barycenter of the lamp unit 7.

In addition, the lamp unit 7 may be supported by the frame so as to be rotatable, for example, in the horizontal direction. If the lamp unit 7 is supported by the frame so as to be rotatable in the horizontal direction, a swivel mechanism (not shown) is connected to the lamp unit 7 and the lamp unit 7 is rotated in the horizontal direction by the operation of the swivel mechanism. Accordingly, the orientation of the optical axis is changed so as to follow the traveling direction of a vehicle.

Meanwhile, if a frame-shaped frame is disposed in the lamp chamber 5, it is preferable that the case portion 44 of the connector case 42 and the connection portions 39*b* and 39*b* of the connection terminal 39 protrude rearward from the inside of the frame. If the case portion 44 and the connection portions 39*b* and 39*b* protrude rearward from the inside of the frame, a disposition space is effectively used for the case portion 44 and the connection portions 39*b* and 39*b*. Accordingly, it may be possible to reduce the size of the vehicle headlight 1 by that much.

Since at least a part of the yoke 19 of the drive mechanism 18 is formed integrally with the stationary shade 12 in the vehicle headlight 1 as described above, it may be possible to reduce the size of the vehicle headlight 1 and the number of components of the vehicle headlight 1. In particular, since a mounting member, which is used to mount the yoke on the stationary shade and is disposed below the yoke, is unnecessary, the height of a beam switching structure, which includes the stationary shade 12 and the movable shade 15, in the up-down direction is reduced by that much. Accordingly, it may be possible to reduce the size of the vehicle headlight 1 in the up-down direction.

Further, since at least a part of the yoke 19 of the drive mechanism 18 is formed integrally with the stationary shade 12, it may be possible to increase the strength of the yoke 19 and to reduce the weight of the yoke 19.

Furthermore, since the middle M of the yoke 19 in the left-right direction and the rotation center S of the movable shade 15 are positioned on the opposite sides of the optical axis P of the light source 11 in the left-right direction, it may be possible to make the barycenter of the lamp unit 7 be close to the middle of the stationary shade in the left-right direction and to improve vibration resistance.

In addition, since the middle M of the yoke 19 is positioned on the left side of the optical axis P and the rotation center S of the movable shade 15 is positioned on the right side of the optical axis P, the drive mechanism 18 and the movable shade 15 are disposed so as to be balanced each other in the left-right direction. Accordingly, it may be possible to reduce the size of the vehicle headlight 1 by the effective use of a disposition space.

Further, the yoke 19 includes the integrated yoke portion 23 and the separate yoke portion 24 joined to the integrated yoke portion 23. Each of the integrated yoke portion 23 and the separate yoke portion 24 includes at least two surface portions (the lower surface portion 25, the side surface portions 26 and 28, the upper surface portion 27, and the front surface portion 29).

Accordingly, it may be possible to easily form the yoke 19 by joining the separate yoke portion 24 to the integrated yoke portion 23.

Furthermore, the closed magnetic path portion 30 is formed in the yoke, one side surface portion 26 and the lower surface portion 25 of the closed magnetic path portion 30 are formed at the integrated yoke portion 23, and the other side surface portion 28 and the upper surface portion 27 of the closed magnetic path portion 30 are formed at the separate yoke portion 24.

Accordingly, it may be possible to increase the driving force of the drive mechanism 18 by the closed magnetic path portion 30 and to easily form the closed magnetic path portion 30 by joining the separate yoke portion 24 to the integrated yoke portion 23.

Moreover, since the front surface portion 29 is formed at the integrated yoke portion 23 or the separate yoke portion 24, not only the closed magnetic path portion 30 but also the front surface portion 29 contributes to the increase of the driving force of the drive mechanism 18 and the inner structure of the yoke 19 is not seen from the outside of the cover 3. Accordingly, it may be possible to improve the appearance of the yoke.

Meanwhile, an example where the yoke 19 is positioned on the front side of the stationary shade 12 has been described above. However, conversely, the yoke 19 may be positioned on the rear side of the stationary shade 12. Meanwhile, since the light source 11 is positioned on the rear side of the stationary shade 12, the yoke 19 does not easily interfere with the path of light emitted from the light source 11 if the yoke 19 is positioned on the front side of the stationary shade 12. Accordingly, it may be possible to position the yoke 19 on the upper side. This contributes to the reduction of the size of the vehicle headlight 1.

Further, the lower surface portion 25, the side surface portions 26 and 28, the upper surface portion 27, and the front surface portion 29, which are five surface portions forming the yoke 19, may be formed as the surface portions of any one of the integrated yoke portion 23 and the separate yoke portion 24. Furthermore, the number of the surface portions of the integrated yoke portion 23 and the separate yoke portion 24 are also arbitrary.

The shape and structure of each portion, which have been described in the above-mentioned preferred embodiment of the invention, are merely examples of the embodiment of the invention, and the technical scope of the invention should not be limited to the shape and structure of each portion.

While aspects of embodiments of the present invention have been shown and described above, other implementations are within the scope of the claims. It will be understood by those skilled in the art that various changes in form and details may be made therein without departing from the spirit and scope of the invention as defined by the appended claims.

What is claimed is:

1. A vehicle headlight comprising:

a lamp casing comprising:

a lamp housing, wherein at least one surface of the lamp housing is opened;

a cover attached to the lamp housing to cover the at least one surface of the lamp housing;

a lamp unit disposed in the lamp casing, the lamp unit comprising:

a light source configured to emit light;

a reflector comprising a reflective surface that reflects the light emitted from the light source;

a projection lens that projects the light emitted from the light source toward a forward area;

a stationary shade disposed between the projection lens and the light source and configured to block a part of the light emitted from the light source a movable shade supported by the stationary shade so as to move between a shielding position and a non-shielding position and configured to block a part of the light emitted from the light source when the movable shade is located in the shielding position;

a drive mechanism configured to rotate the movable shade, the drive mechanism comprising:

a yoke;

a coil disposed in the yoke; and an output shaft configured to move in an axial direction thereof in response to current supplied to the coil, and a transmission mechanism configured to transmit a driving force of the drive mechanism to the movable shade, wherein at least a part of the yoke of the drive mechanism is a single piece with the stationary shade, wherein the stationary shade includes a light transmission hole having a first light transmission portion and a second light transmission portion, and a center point of the second light transmission portion is located at a center of a horizontal axis of the stationary shade; wherein the movable shade blocks an area of the second light transmission portion in the shielding position.

2. The vehicle headlight according to claim 1, wherein an optical axis of the light source is located between a middle of the yoke in a left-right direction thereof and a rotation center of the movable shade in a left-right direction orthogonal to a longitudinal direction of the vehicle headlamp.

3. The vehicle headlight according to claim 1, wherein the yoke comprises: a plurality of surface portions, the yoke comprises:

an integrated yoke portion formed in a single piece with the stationary shade; and a separate yoke portion connected to the integrated yoke portion and formed separately from the stationary shade, and each of the integrated yoke portion and the separate yoke portion comprises at least two surface portions of the surface portions.

4. The vehicle headlight according to claim 3, wherein the yoke forms a closed magnetic path portion formed in a rectangular frame and having an opening in a longitudinal direction of the vehicle headlamp, the closed magnetic path portion having four surface portions, wherein the four surface portions of the closed magnetic path portion has: a first side surface portion; a lower surface portion; a second side surface portion; and an upper surface portion, the integrated yoke portion comprises: the first side surface portion; and the lower surface portion, and the separate yoke portion comprises: the second side surface portion; and the upper surface portion.

5. The vehicle headlight according to claim 4, wherein either the integrated yoke portion or the separate yoke portion further comprises a front surface portion configured to cover the opening of the closed magnetic path portion.

6. The vehicle headlight according to claim 1, wherein the at least part of the yoke of the drive mechanism extends from the bottom of the stationary shade.

7. The vehicle headlight according to claim 1, wherein the yoke further includes:

a connection terminal and at least one or more diodes, wherein the at least one or more diodes are configured to absorb a magnetic energy discharged by the coil.

* * * * *